US012396503B2

(12) United States Patent
Hong

(10) Patent No.: US 12,396,503 B2
(45) Date of Patent: Aug. 26, 2025

(54) METHOD OF MANUFACTURING A THREE-FOLD TIE WITH BODY FOLDED TWICE BY GATEFOLD

(71) Applicant: Jong Pyo Hong, Seoul (KR)

(72) Inventor: Jong Pyo Hong, Seoul (KR)

( * ) Notice: Subject to any disclaimer, the term of this patent is extended or adjusted under 35 U.S.C. 154(b) by 0 days.

(21) Appl. No.: 18/596,680

(22) Filed: Mar. 6, 2024

(65) Prior Publication Data

US 2024/0206575 A1 Jun. 27, 2024

Related U.S. Application Data

(63) Continuation of application No. 18/018,268, filed as application No. PCT/KR2021/010278 on Aug. 4, 2021, now abandoned.

(30) Foreign Application Priority Data

Aug. 5, 2020 (KR) ..... 10-2020-0098136

(51) Int. Cl.
*A41D 25/00* (2006.01)

(52) U.S. Cl.
CPC ..... *A41D 25/001* (2013.01)

(58) Field of Classification Search
CPC ..... A41D 25/06; A41D 25/001; A41D 25/00; A41D 25/16
See application file for complete search history.

(56) References Cited

U.S. PATENT DOCUMENTS 1,599,950 A 9/1926 Blanchard
1,782,183 A 11/1930 Strauss
1,885,956 A 11/1932 Simson
2,086,365 A 7/1937 Rehor
2,179,133 A 11/1939 Rehor
2,205,105 A 6/1940 Naftali
2,304,935 A 12/1942 Langsdorf
2,413,398 A 12/1946 Whitman
2,504,843 A 4/1950 Kaplan
2,611,900 A 9/1952 Hertz
2,887,687 A 5/1959 Bergheim
3,657,743 A 4/1972 Bucci
3,720,958 A 3/1973 Cowdrey
(Continued)

FOREIGN PATENT DOCUMENTS

EP 1284108 A2 2/2003
FR 2899071 A1 10/2007
(Continued)

OTHER PUBLICATIONS

International Search Report for PCT/KR2021/010278 mailed Nov. 11, 2021 from Korean Intellectual Property Office.

*Primary Examiner* — Alissa L Hoey
(74) *Attorney, Agent, or Firm* — Revolution IP, PLLC

(57) ABSTRACT

A three-fold tie with a body folded twice by a gatefold, includes: a body of fabric where body part fabric is folded once by a gatefold and folded once more by a gatefold so that both ends overlap; a blade portion of fabric where sword-shaped blade part fabric is folded once by a gatefold so that both ends overlap and fabric part of the overlapped upper end is folded inward once more; and a tail portion of fabric where sword-shaped tail part fabric is folded once by a gatefold so that both ends overlap and fabric part of the overlapped upper end is folded inward once more.

4 Claims, 10 Drawing Sheets

(56) References Cited

U.S. PATENT DOCUMENTS

| | | | | |
|---|---|---|---|---|
| 4,123,802 | A | 11/1978 | Ackerman | |
| 4,506,389 | A | 3/1985 | Franklin | |
| 4,694,509 | A | 9/1987 | Grubman | |
| 5,012,530 | A | 5/1991 | Ackerman | |
| 6,205,587 | B1 | 3/2001 | Shiffler | |
| 6,233,741 | B1 | 5/2001 | Loree et al. | |
| 6,243,874 | B1 | 6/2001 | Yoon | |
| 6,550,650 | B2 | 4/2003 | Fortier | |
| 6,687,914 | B2 * | 2/2004 | Conyers | A41D 25/00 2/144 |
| 8,117,671 | B2 | 2/2012 | Kim | |
| 2009/0172863 | A1 | 7/2009 | Somma | |
| 2009/0265833 | A1 | 10/2009 | Kim | |
| 2018/0263318 | A1 | 9/2018 | David | |

FOREIGN PATENT DOCUMENTS

| | | | |
|---|---|---|---|
| GB | 2295764 | A | 6/1996 |
| KR | 10-1993-0007393 | A | 5/1993 |
| KR | 20-0337512 | Y1 | 12/2003 |

* cited by examiner

METHOD OF MANUFACTURING A THREE-FOLD TIE WITH BODY FOLDED TWICE BY GATEFOLD

CROSS REFERENCE TO RELATED APPLICATIONS

This application is a Continuation of U.S. patent application Ser. No. 18/018,268 filed on Jan. 27, 2023, which is a National Stage Patent Application of PCT International Patent Application No. PCT/KR2021/010278 filed on Aug. 4, 2021, which claims priority to Korean Patent Application No. 10-2020-0098136 filed on Aug. 5, 2020, which are all hereby incorporated by reference in their entirety.

BACKGROUND OF THE INVENTION

The present invention relates to a tie to enable more people to experience an elegant knot of a seven-fold tie.

What is Gatefold?

FIG. 1 shows a plan view of square fabric. The fabric is folded like a double door when folded along a dotted line. This is a gatefold. Three panels are formed by a gatefold, wherein the left and right panels are half the width of the center panel and folded inward to meet in the middle without overlapping. In FIG. 1, the square fabric is folded once by a gatefold. In FIG. 2, the fabric is folded once more by a gatefold after the process in FIG. 1. FIG. 3 is a cross section of the square fabric when folded once by a gatefold. FIG. 4 is a cross section of the square fabric when folded twice by a gatefold.

What Makes the Knot of Seven-Fold Ties Different

A knot of a tie is made within a body so its shape is determined by the combination of the structure (e.g., how body part fabric is folded) and components of the body. FIG. 11 is a cross section of a body 711 of a seven-fold tie. FIG. 9 is a cross section of a body 311 of a three-fold tie. As can be seen in FIG. 11, the body 711 of the seven-fold tie has a structure where body part fabric 7001 is folded once by a gatefold and folded once more by a gatefold so that both ends overlap, which is a structure where the body part fabric 7001 is folded twice by a gatefold. Meanwhile the body 311 of the three-fold tie has a structure where body part fabric 3001 is folded once by a gatefold so that both ends overlap and a fabric part 3106 of the overlapped upper end is folded inward once more. For reference, folding the fabric part 3106 of the overlapped upper end inward once more is for finishing (Explanation 1), and has little effect on the thickness of the body 311. Thus interlining 301 is inserted into the body 311 of the three-fold tie where the body part fabric 3001 is folded once by a gatefold to compensate for the thickness of the tie. As such, the body 711 of the seven-fold tie and the body 311 of the three-fold tie have different structures and components, and thus knots of the two different types of ties are distinctly different. The shape of the knot of the three-fold tie is determined by the combination of the interlining 301 and the body part fabric 3001 folded once by a gatefold within the body 311. Thus, the elegance of good fabric is not fully contained in the knot due to the interlining 301 inserted to compensate for the thickness of the three-fold tie. Meanwhile the seven-fold tie is made only by folding the fabric without interlining, and thus the elegance of good fabric is intact in the knot thereof. This is why the knot of seven-fold ties gives differentiated elegance.

(Explanation 1) Finishing: when the body part fabric 3001 is folded once by a gatefold within the body 311 of the three-fold tie so that both ends overlap, a section of the fabric part 3106 of the overlapped upper end is exposed to the outside. Thus, it is necessary to fold the fabric part 3106 of the overlapped upper end inward once more so that the section of the fabric part 3106 is not exposed to the outside.

What Makes Seven-Fold Ties Expensive

Reliance on Overseas Production

Domestic tie manufacturing plants have been intensively producing three-fold ties for a long time, a product of mass production. The manufacturing process is designed accordingly. Thus, producing handicrafts such as seven-fold ties which are difficult to produce and require long time effort has been discouraged. Seven-fold ties may be manufactured domestically, and there have been such attempts. However, the quality of manufactured products is poor due to the absence of skilled manufacturers.

Meanwhile production based on artisan culture has been developed in European countries such as Italy and France, and thus people in those countries are familiar with making seven-fold ties which require craftsmanship.

For this reason, there is a difference in quality comparing seven-fold ties made by skilled artisans overseas with seven-fold ties made by unskilled domestic workers. Thus, there is no choice but to have seven-fold ties made by skilled artisans overseas.

If seven-fold ties are made by skilled artisans overseas, expensive labor costs have to be paid to the makers. In addition, expensive overseas shipping costs and custom duties that would not have to be paid for domestic production are added to the production cost of products.

A Relatively Large Amount of Fabric Required to Produce Seven-Fold Ties

Table 1 compares the amounts of fabric required to make one piece of three-fold tie and one piece of seven-fold tie. As can be seen in Table 1, about 60 cm of fabric (based on a fabric with a width of 100 cm) is required to make one piece of a seven-fold tie. This is close to three times the amount of fabric required to make one piece of three-fold tie (22 cm).

TABLE 1

| | The amount of fabric required to make one piece of tie (based on a fabric with a width of 100 cm) | |
|---|---|---|
| Three-fold tie | About 22 cm | |
| Seven-fold tie | About 60 cm | Compared to a three-fold tie, about 3 times as much fabric is required |

In FIG. 18, a pattern 700 of a seven-fold tie and a pattern 300 of a three-fold tie are superimposed. As can be seen in FIG. 18, the seven-fold tie requires a relatively large amount of fabric compared to the three-fold tie. A large difference in the amount of fabric may be seen particularly in the blade portion and the tail portion.

A Large Amount of Time Required to Produce Seven-Fold Ties

Seven-fold ties are handicrafts and it take a lot of production time per unit product. This causes its supply to be limited, and the limited supply naturally leads to an increase in selling price.

Standardized Structure and Manufacturing Method of Ties

The structure and manufacturing method of three-fold ties and seven-fold ties are standardized.

Details of the Production of Three-Fold Ties

Three-Fold Tie with Lining

Prepare fabric and a pattern 300 of a three-fold tie to produce a tie.

After the preparing step, cut the fabric to fit the pattern 300.

After the cutting step, add a lining to blade part fabric 3000 and tail part fabric 3002.

After the adding step, place tie interlining 301 on the center of the cut fabric as shown in FIG. 6.

After the placing step, fold the fabric by a gatefold once so that both ends overlap as shown in FIG. 7.

After the folding step, fold fabric part of the overlapped upper end inward for finishing as shown in FIG. 8.

After the folding step, sew the interlining 301 and left and right panels formed by folding the fabric by a gatefold with a long single thread to fix them.

After the sewing step, fix a blade portion 310 and a tail portion 312 using a bar tack.

After the fixing step, attach a keeper loop, brand label, care label, etc. to the tie according to one's preferences.

Three-Fold Tie without Lining (Sfoderato Three-Fold Tie)

Prepare fabric and a pattern 300 of a three-fold tie to produce a tie.

After the preparing step, cut the fabric to fit the pattern 300.

After the cutting step, roll up and sew edges of blade part fabric 3000 and tail part fabric 3002.

After the rolling up and sewing step, place tie interlining 301 on the center of the cut fabric as shown in FIG. 6.

After the placing step, fold the fabric by a gatefold once so that both ends overlap as shown in FIG. 7.

After the folding step, fold fabric part of the overlapped upper end inward for finishing as shown in FIG. 8.

After the folding step, sew the interlining 301 and left and right panels formed by folding the fabric by a gatefold with a long single thread to fix them.

After the sewing step, fix a blade portion 310 and a tail portion 312 using a bar tack.

After the fixing step, cut the interlining 301 from the bottom of the bar tack.

After the cutting step, attach a keeper loop, brand label, care label, etc. to the tie according to one's preferences.

Details of the Production of Seven-Fold Ties

Prepare fabric and a pattern 700 of a seven-fold tie to produce a tie.

After the preparing step, cut the fabric to fit the pattern 700.

After the cutting step, adding a lining to blade part fabric 7000 and tail part fabric 7002. When a Sfoderato method is used to produce the tie, roll up and sew edges of the blade part fabric 7000 and the tail part fabric 7002.

After the adding step, fold the blade part fabric 7000 and the tail part fabric 7002 seven times, and fold body part fabric 7001 once by a gatefold and fold once more by a gatefold so that both ends overlap.

After the folding step, sew left and right panels formed by folding the fabric with a long single thread to fix them.

After the sewing step, fix a blade portion 710 and a tail portion 712 using a bar tack.

After the fixing step, attach a keeper loop, brand label, care label, etc. to the tie according to one's preferences.

What is Sfoderato Tie?

Sfoderato is an Italian word. It is translated into "without a lining." Thus, Sfoderato ties literally mean "ties without a lining." As linings may be seen on the inside of jackets, linings may also be seen on the back of a blade portion and a tail portion of a tie. Sfoderato ties are ties without this kind of linings. For Sfoderato ties, linings are not used but edges of blade part fabric and tail part fabric are rolled up and sewn.

SUMMARY OF THE INVENTION

A knot of a seven-fold tie presents differentiated elegance. However, seven-fold ties are too expensive for many people to enjoy. For this reason, seven-fold ties are consumed only by some enthusiasts or a few people who can afford to buy them. This invention is for making more people experience the elegant knot of seven-fold ties.

FIG. 10 shows a pattern 700 of a seven-fold tie. The seven-fold tie is divided into three parts as follows: a body 711, a blade portion 710 and a tail portion 712. A knot of a tie is made within a body, so the body 711 is a main factor that makes a knot of a seven-fold tie elegant while other two parts are not. However, the blade portion 710 and tail portion 712 are main factors that increase the price of the seven-fold tie. Thus, it is necessary to change the structure of the blade portion 710 and the tail portion 712 while maintaining that of the body 711. The structure of the blade portion 710 and the tail portion 712 is changed to that of a three-fold tie.

FIG. 12 is a plan view of a pattern (one continuous fabric piece) 100 of the invented tie to solve the problem. As can be seen in FIG. 12, the pattern (one continuous fabric piece) 100 includes a body part (111), a head part (110), and a tail part (112). The body part 111 has a structure of a seven-fold tie where body part fabric 1001 is folded once by a first gatefold and folded once more by a second gatefold so that both ends overlap, which is a structure where the body part fabric 1001 is folded twice by the first and second gatefolds. The blade and tail portions 710 and 712 in FIG. 10 which increase the cost of seven-fold tie are produced by changing the structure thereof to that of a three-fold tie which is a structure where sword-shaped blade and tail part fabrics 1000 and 1002 are folded once by a gatefold so that both ends overlap and fabric parts 1106 and 1126 of overlapped upper ends are folded inward once more for finishing. In FIG. 12, the head part located at a middle portion of the continuous fabric piece has a tapered end at a first end portion of the middle portion with a first step difference having a width narrower than a width of the middle portion. The first step difference forms one of a right angle, an acute angle, or an obtuse angle with respect to a longitudinal edge of the continuous fabric piece. The tail part has a tapered end at a second end portion of the middle portion with a second step difference having a width narrower than the width of the middle portion. The body part is divided into seven panels by six longitudinal folding lines consisting of a first, second, third, fourth, fifth, and sixth folding lines. The head part includes the third, fourth, and fifth folding lines extending from the body part. The tail part includes the third, fourth, and fifth folding lines extending from the body part. The one continuous fabric piece is folded by the first gatefold along the second and fifth folding lines such that outer ends of the continuous fabric piece are folded inwardly up to a longitudinal center region of the body part without overlapping. After the first gatefold is performed, the second folding line becomes a first outer edge of the one continuous fabric piece, and the fifth folding line becomes a second outer edge of the one continuous fabric piece as such the fifth folding line of the head, body, and tail parts is folded during the step of performing the first gatefold. The one continuous fabric piece is folded by the second gatefold along the third and fourth folding lines such that outer ends of the first gatefold are folded inwardly with overlapping, thereby forming a thickness suitable for making knots.

Regarding the connection between the body 111 and the blade portion 110 and between the body 111 and the tail portion 112, the body 111 is connected to the blade portion 110 while sections 1111 and 1101 are symmetrical in one part of the body 111, and the body 111 is connected to the tail portion 112 while sections 1111 and 1121 are symmetrical in the other part of the body 111, wherein the sections 1101, 1121 and 1111 are sections of fabric parts exposed to the outside of the blade portion 110, the tail portion 112 and the body 111, respectively.

Why are the blade portion 110 and the tail portion 112 of the invention produced in the structure of a three-fold tie? This is because the three-fold tie is a product of mass production. A series of production processes are efficiently optimized for the three-fold tie. Thus, it is the most efficient to make the blade portion and the tail portion in a three-fold tie structure.

Why is the body part fabric 1001 folded by a gatefold twice within the body 111 of the invention? This is because the body part fabric 7001 is folded by a gatefold twice within the body 711 of the seven-fold tie. When the body part fabric is folded twice by a gatefold, the body has a thickness suitable for making knots. However, when the body part fabric is folded only once by a gatefold, the body is so thin that interlining needs to be added thereto. When the body part fabric is folded three times by a gatefold, the body is so thick that a knot is not properly made.

The tie invented to solve the problem has the same body structure as a seven-fold tie, and thus it enables the same experience as a knot of a seven-fold tie. However, a blade portion and a tail portion of the tie are made in a three-fold tie structure, which enables the reduction of production costs. In detail, domestic production became possible by lowering the production difficulty. Thus, there is no need to have products manufactured overseas while paying expensive labor costs, overseas shipping costs, and customs duties. In addition, the production time per unit product was reduced compared to seven-fold ties. This allows a larger supply and prevent an increase in selling price due to the scarcity of products. Lastly, the amount of fabric required for production per unit product is reduced compared to seven-fold ties. FIG. 19 is a plan view in which the pattern 700 of the seven-fold tie and the pattern 100 of the present invention are superimposed. As can be seen in FIG. 19, a large amount of fabric is saved in the blade portion 110 and the tail portion 112.

DESCRIPTION OF NUMERALS

Figure 1:
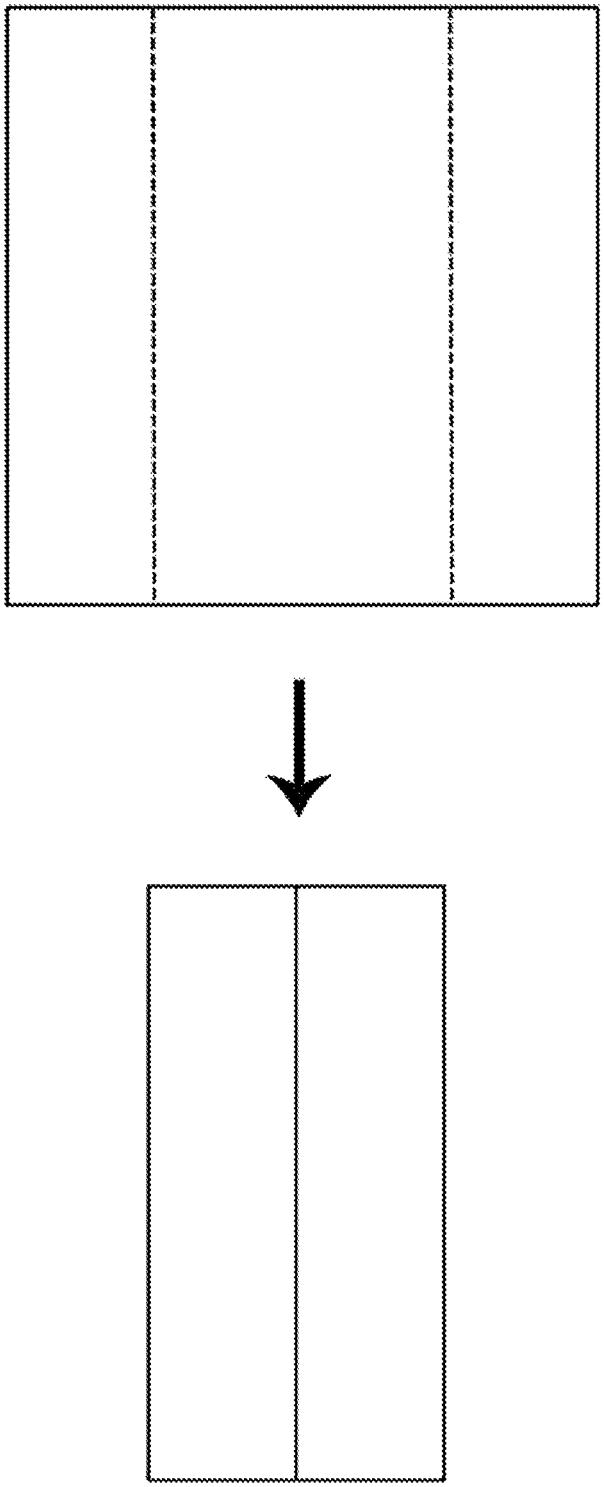
FIG. 1 Prior Art
FIG. 1 is a plan view showing that square fabric is folded once by a gatefold.
Figure 2:
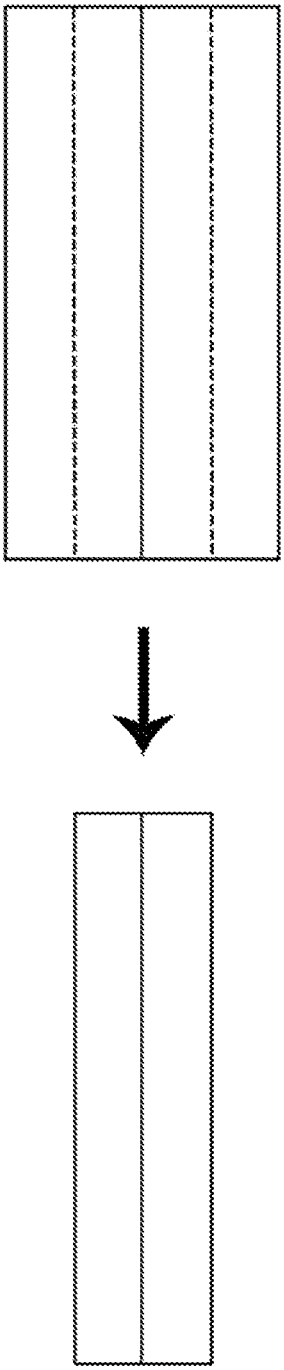
FIG. 2 Prior Art
FIG. 2 is a plan view showing that square fabric that has already been folded once by a gatefold is folded once more by a gatefold.
Figure 3:
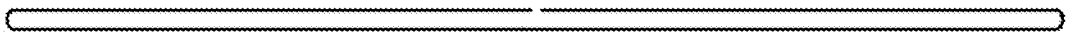
FIG. 3 Prior Art
FIG. 3 is a cross section of square fabric when folded once by a gatefold.
Figure 4:
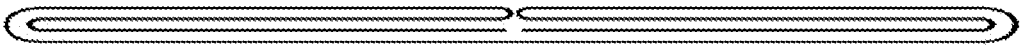
FIG. 4 Prior Art
FIG. 4 is a cross section of square fabric when folded twice by a gatefold.
Figure 5:
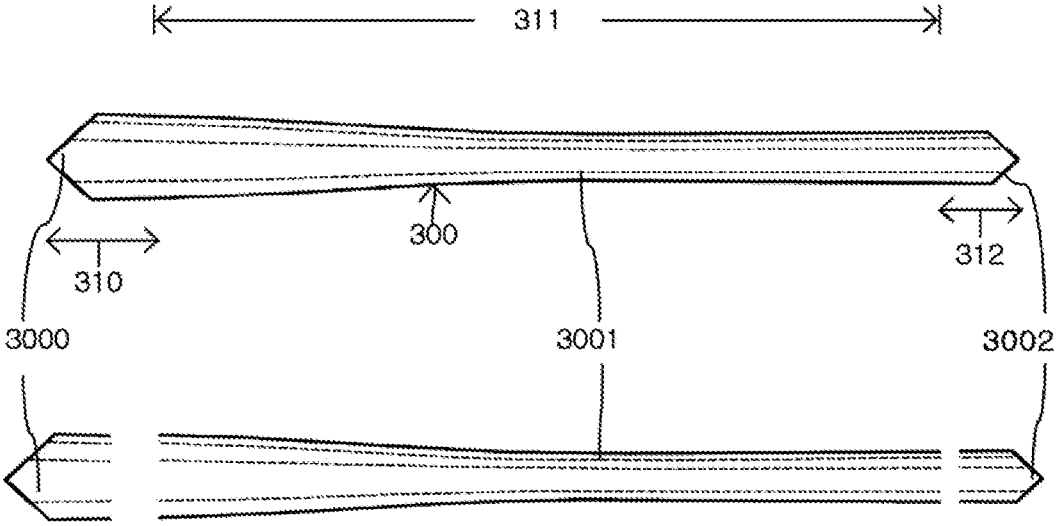
FIG. 5 Prior Art
FIG. 5 is a plan view of a pattern 300 of a three-fold tie.
Figure 6:
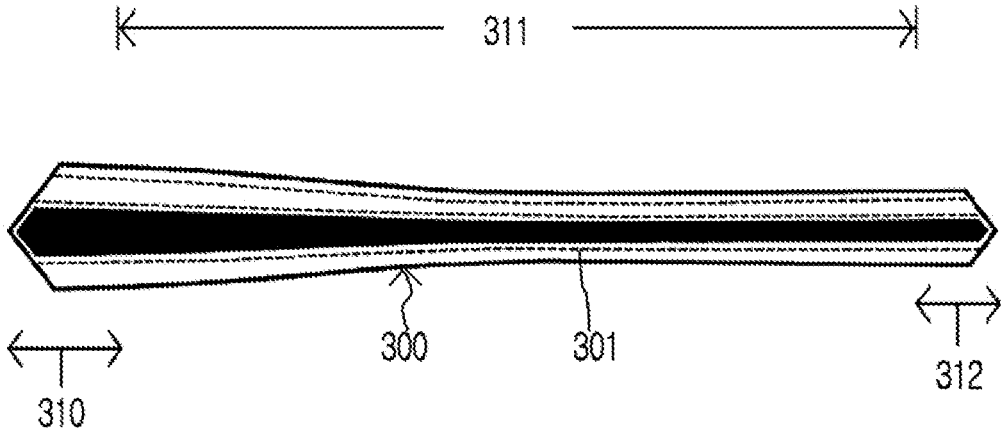
FIG. 6 Prior Art
FIG. 6 is a plan view in which interlining 301 is placed on the center of the fabric cut to fit the pattern 300 of the three-fold tie.
Figure 7:
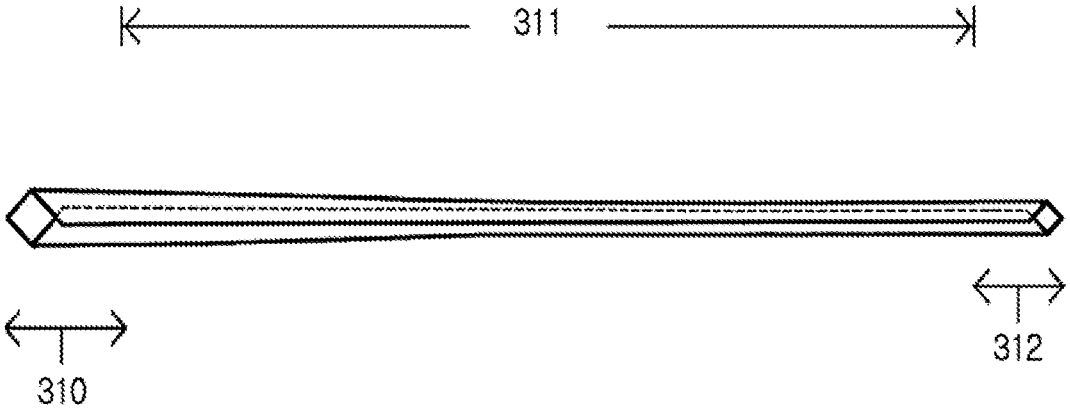
FIG. 7 Prior Art
FIG. 7 is a plan view in which the fabric cut to fit the pattern 300 of the three-fold tie is folded once by a gatefold so that both ends overlap.
Figure 8:
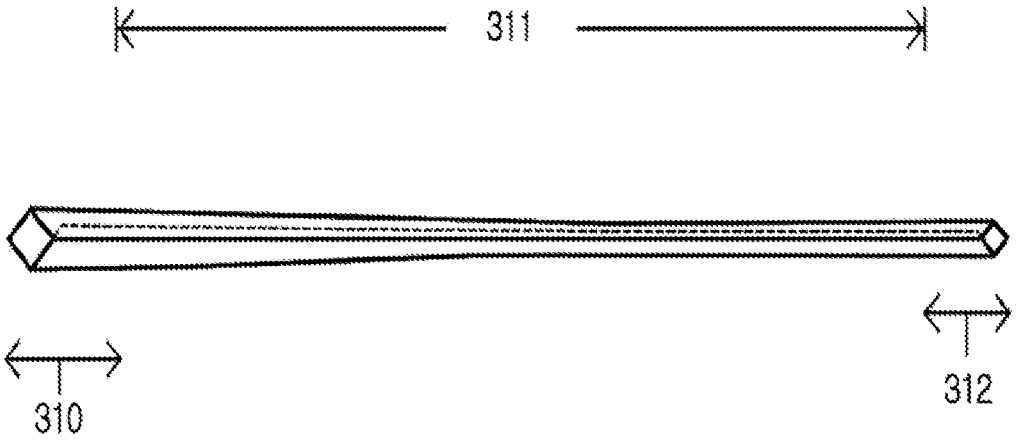
FIG. 8 Prior Art
FIG. 8 is a plan view in which fabric cut to fit the pattern 300 of the three-fold tie is folded once by a gatefold so that both ends overlap and a fabric part of the overlapped upper end is folded inward once more.
Figure 9:
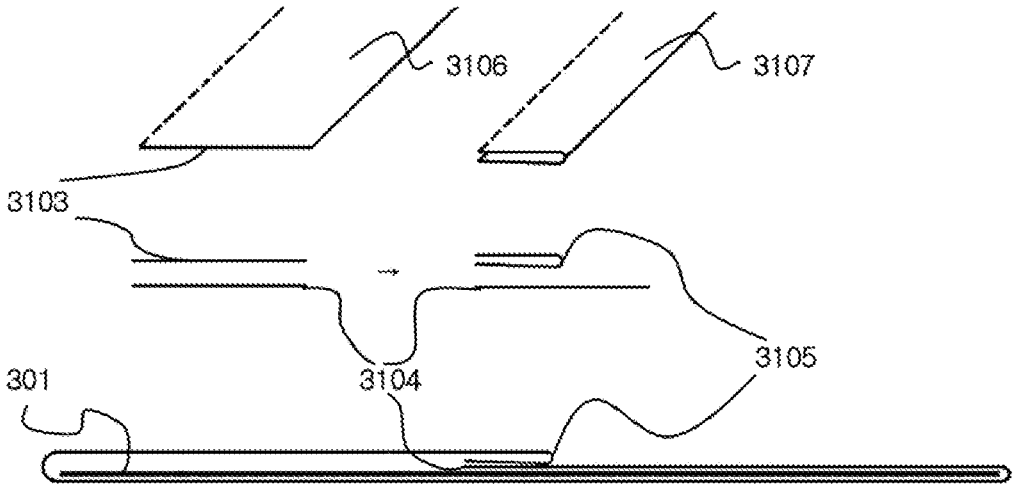
FIG. 9 Prior Art
FIG. 9 is a cross section of a body 311 of the three-fold tie.
Figure 10:
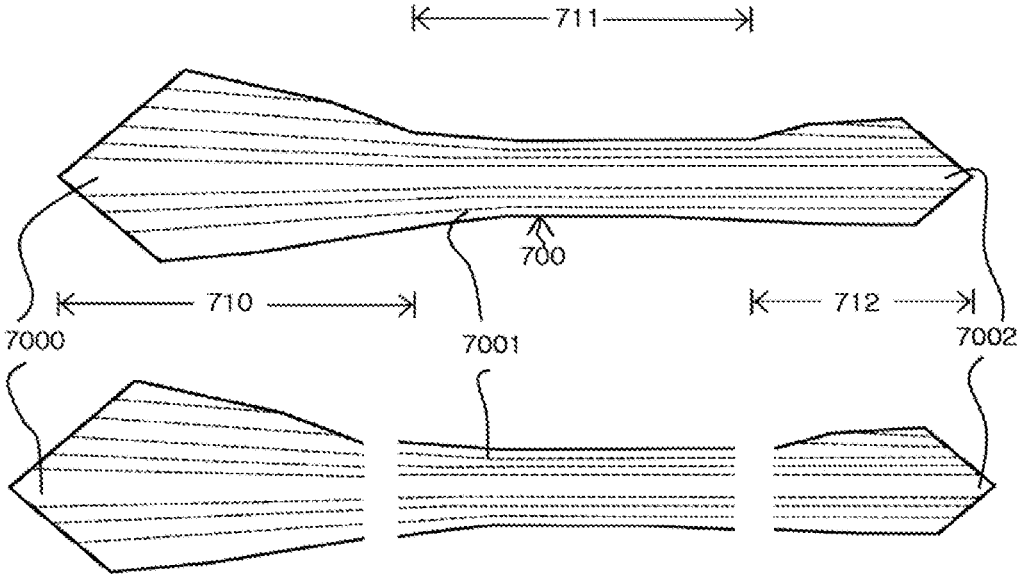
FIG. 10 Prior Art
FIG. 10 is a plan view of a pattern 700 of a seven-fold tie.
Figure 11:
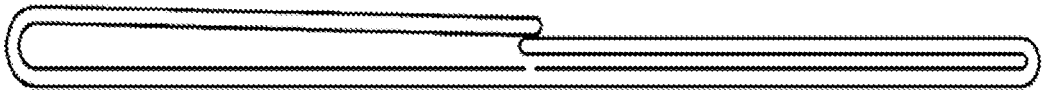
FIG. 11 Prior Art
FIG. 11 is a cross section of a body 711 of the seven-fold tie.
Figure 12:
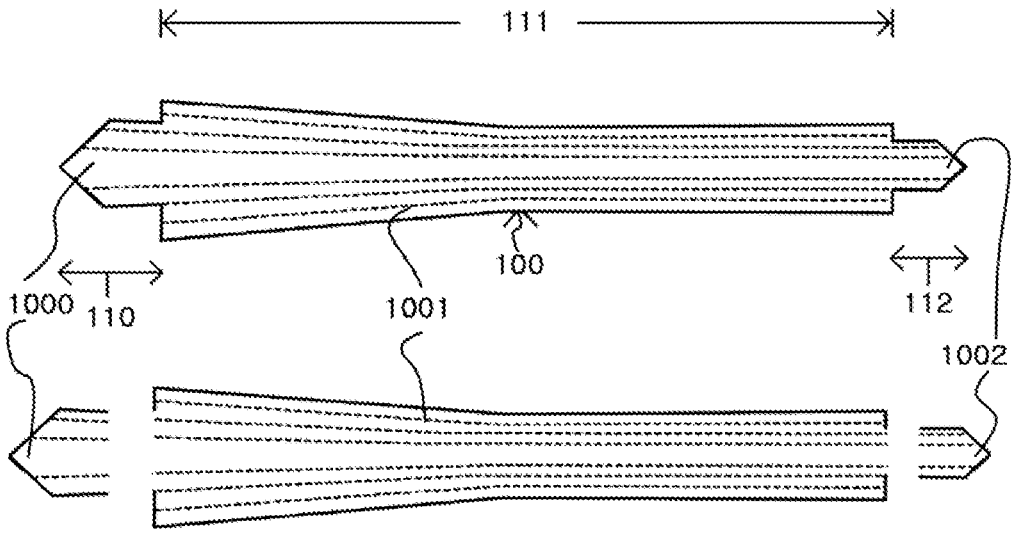
FIG. 12 is a plan view of a pattern 100 of the invented tie.

100: Pattern of invented tie
110: Blade portion of invented tie
111: Body of invented tie
112: Tail portion of invented tie
1000: Blade part fabric of invented tie
1001: Body part fabric of invented tie
1002: Tail part fabric of invented tie
1101: Section of fabric part exposed to outside of blade portion 110 of invented tie
1102: Section of fabric part not exposed to outside of blade portion 110 of invented tie
1111: Section of fabric part exposed to outside of body 111 of invented tie
1112: Section of fabric part not exposed to outside of body 111 of invented tie
1121: Section of fabric part exposed to outside of tail portion 112 of invented tie
1122: Section of fabric part not exposed to outside of tail portion 112 of invented tie
1103: Section of fabric part 1106 of overlapped upper end within blade portion 110 of invented tie
1104: Section of fabric part of overlapped lower end within blade portion 110 of invented tie
1123: Section of fabric part 1126 of overlapped upper end within tail portion 112 of invented tie
1124: Section of fabric part of overlapped lower end within tail portion 112 of invented tie
1105: Section of fabric part 1106 of overlapped upper end folded inward within blade portion 110 of invented tie
1125: Section of fabric part 1126 of overlapped upper end folded inward within tail portion 112 of invented tie
1106: Fabric part of overlapped upper end within blade portion 110 of invented tie
1107: Fabric part of overlapped upper end folded inward within blade portion 110 of invented tie
1126: Fabric part of overlapped upper end within tail portion 112 of invented tie
1127: Fabric part of overlapped upper end folded inward within tail portion 112 of invented tie
300: Pattern of three-fold tie
301: Interlining of three-fold tie
310: Blade portion of three-fold tie
311: Body of three-fold tie

312: Tail portion of three-fold tie
3000: Blade part fabric of three-fold tie
3001: Body part fabric of three-fold tie
3002: Tail part fabric of three-fold tie
3103: Section of fabric part 3106 of overlapped upper end within body 311 of three-fold tie
3104: Section of fabric part of overlapped lower end within body 311 of three-fold tie
3105: Section of fabric part 3106 of overlapped upper end folded inward within body
311 of three-fold tie
3106: Fabric part of overlapped upper end within body 311 of three-fold tie
3107: Fabric part of overlapped upper end folded inward within body 311 of three-fold tie
700: Pattern of seven-fold tie
710: Blade portion of seven-fold tie
711: Body of seven-fold tie
712: Tail portion of seven-fold tie
7000: Blade part fabric of seven-fold tie
7001: Body part fabric of seven-fold tie
7002: Tail part fabric of seven-fold tie

DETAILED DESCRIPTION OF THE INVENTION

Best Mode for Carrying Out the Invention

Prepare fabric and a pattern 100 of invented tie to produce a tie.

After the preparing step, cut the fabric to fit the pattern 100.

After the cutting step, add a lining to blade part fabric 1000 and tail part fabric 1002.

Figure 13:
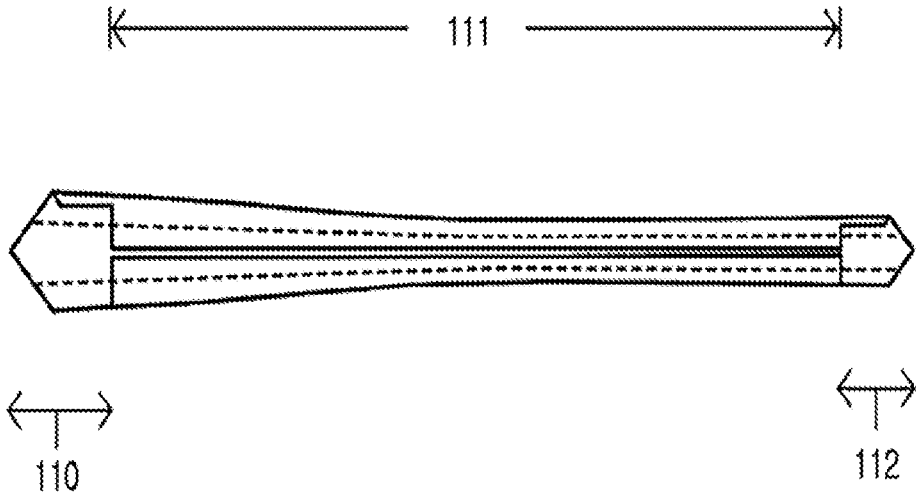
FIG. 13 is a plan view in which the fabric cut to fit the pattern 100 of the invented tie is folded once by a gatefold.
Figure 14:
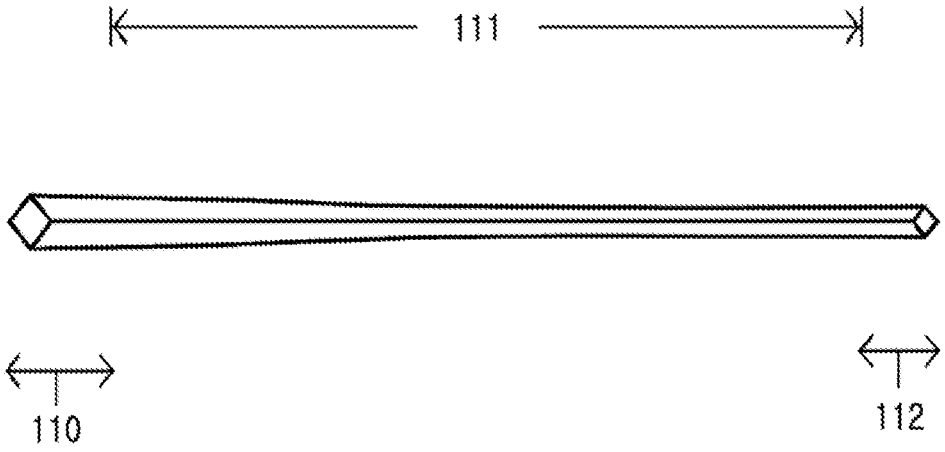
FIG. 14 is a plan view of the invented tie.
Figure 15:
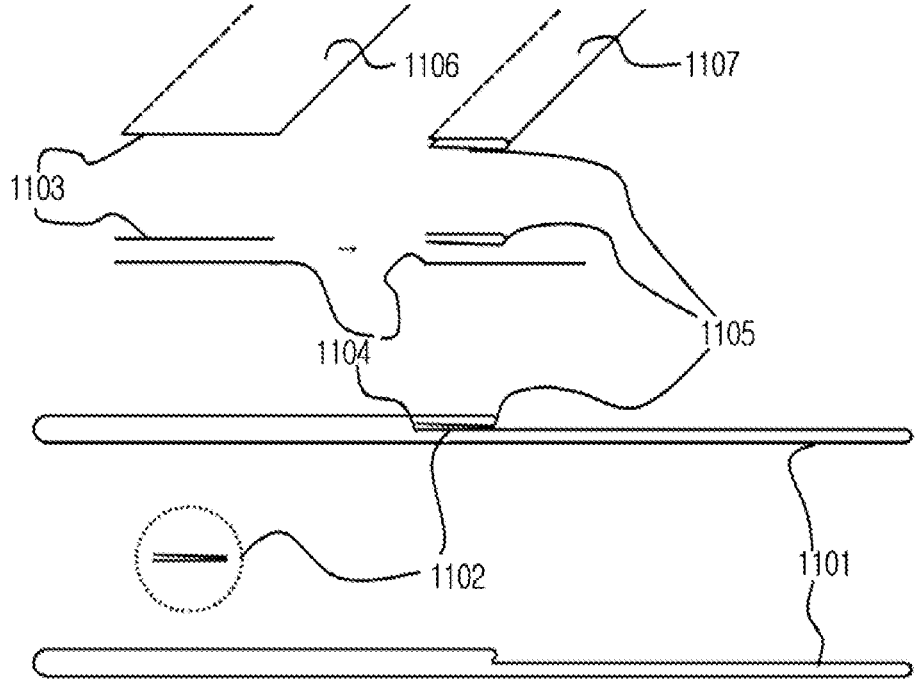
FIG. 15 is a cross section of a blade portion 110 of the invented tie.
Figure 16:
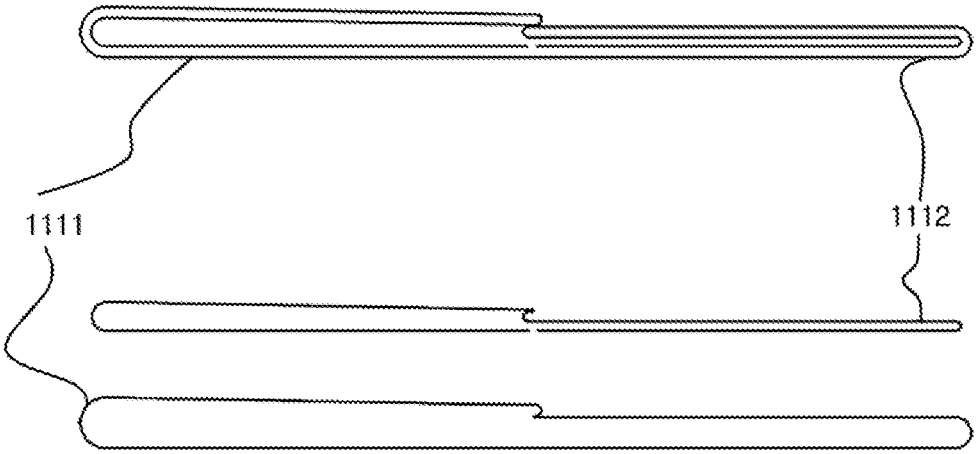
FIG. 16 is a cross section of a body 111 of the invented tie.
Figure 17:
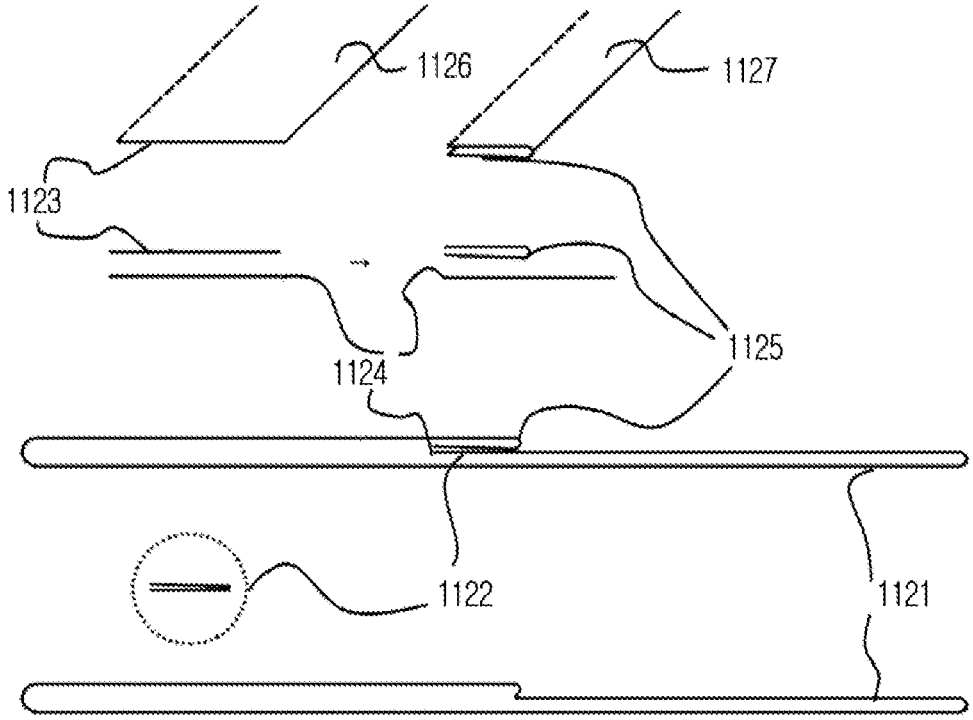
FIG. 17 is a cross section of a tail portion 112 of the invented tie.
Figure 18:
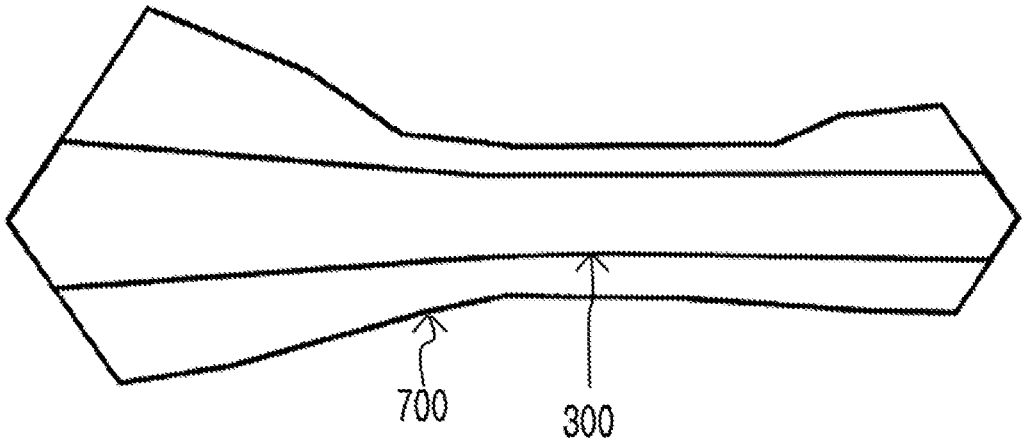
FIG. 18 is a plan view in which a pattern 300 of a three-fold tie and a pattern 700 of a seven-fold tie are superimposed.
Figure 19:
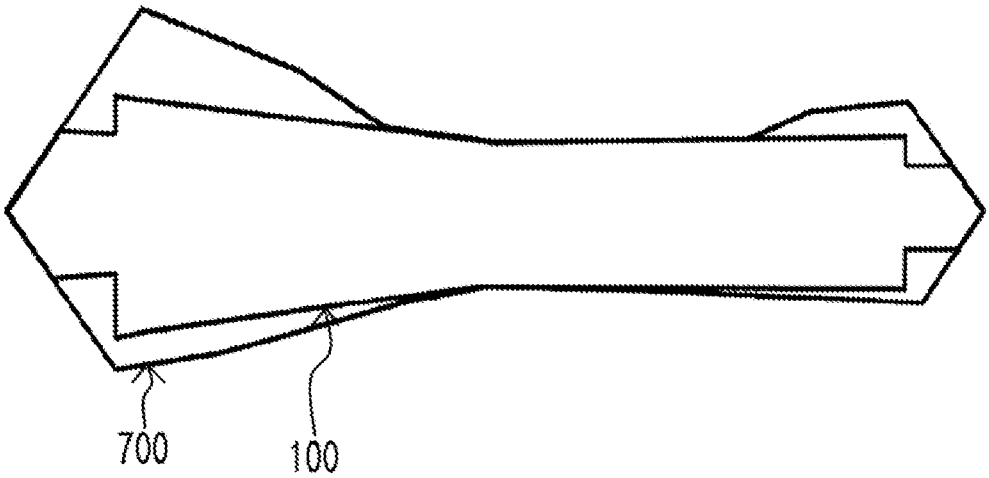
FIG. 19 is a plan view in which the pattern 100 of the invented tie and the pattern 700 of the seven-fold tie are superimposed.

After the adding step, fold the cut fabric once by a gatefold as shown in FIG. 13. Fold only the body part fabric 1001 in one part of the tie, and fold not only the body part fabric 1001 but also the blade part fabric 1000 and the tail part fabric 1002 for finishing of the blade portion 110 and the tail portion 112 in the other part of the tie.

After the folding step, fold the entire fabric once more by a gatefold so that both ends overlap.

After the folding step, sew left and right panels formed by folding the fabric by a gatefold with a long single thread to fix them.

After the sewing step, fix a blade portion 110 and a tail portion 112 using a bar tack.

After the fixing step, attach a keeper loop, brand label, care label, etc. to the tie according to one's preferences.

Mode for Carrying Out the Invention

Prepare fabric and a pattern 100 of invented tie to produce a tie.

After the preparing step, cut the fabric to fit the pattern 100.

After the cutting step, roll up and sew edges of blade part fabric 1000 and tail part fabric 1002.

After the rolling up and sewing step, fold the cut fabric once by a gatefold as shown in FIG. 13. Fold only the body part fabric 1001 in one part of the tie, and fold not only the body part fabric 1001 but also the blade part fabric 1000 and the tail part fabric 1002 for finishing of the blade portion 110 and the tail portion 112 in the other part of the tie.

After the folding step, fold the entire fabric once more by a gatefold so that both ends overlap.

After the folding step, sew left and right panels formed by folding the fabric by a gatefold with a long single thread to fix them.

After the sewing step, fix a blade portion 110 and a tail portion 112 using a bar tack.

After the fixing step, attach a keeper loop, brand label, care label, etc. to the tie according to one's preferences.

Ties are a favorite product for many people around the world. According to Euromonitor, the US tie market is projected to hit $758.5 (million) and $769.0 (million) in 2022 and 2023, respectively. In addition, since the present invention is invented based on current technology, it may be produced right away. Based on the two factors mentioned above, the present invention is industrially applicable.

The invention claimed is:

1. A method of manufacturing a three-fold tie, the method comprising:

forming one continuous fabric piece comprising:

a body part at a middle portion of the continuous fabric piece;

a head part having a tapered end at a first end portion of the middle portion with a first step difference having a width narrower than a width of the middle portion; and a tail part having a tapered end at a second end portion of the middle portion with a second step difference having a width narrower than the width of the middle portion, wherein the body part is divided into seven panels by six longitudinal folding lines consisting of a first, second, third, fourth, fifth, and sixth folding lines, the head part includes only the third, fourth, and fifth folding lines extending from the body part, and the tail part includes only the third, fourth, and fifth folding lines extending from the body part;

performing a first gatefold on the one continuous fabric piece along the second and fifth folding lines such that outer ends of the continuous fabric piece are folded inwardly up to a longitudinal center region of the body part without overlapping, wherein, after the first gatefold is performed, the second folding line becomes a first outer edge of the one continuous fabric piece, and the fifth folding line becomes a second outer edge of the one continuous fabric piece as such the fifth folding line of the head, body, and tail parts is folded during the step of performing the first gatefold; and performing a second gatefold on the one continuous fabric piece along the third and fourth folding lines such that outer ends of the first gatefold are folded inwardly with overlapping, thereby forming a thickness suitable for making knots.

2. The method of claim 1, wherein the first step difference forms one of a right angle, an acute angle, or an obtuse angle with respect to a longitudinal edge of the continuous fabric piece.

3. The method of claim 1, wherein the second step difference forms one of a right angle, an acute angle, or an obtuse angle with respect to a longitudinal edge of the continuous fabric piece.

4. The method of claim 1, further comprising sewing the overlapped portions formed by the second gatefold with a single thread.

* * * * *